United States Patent [19]

Wright

[11] 4,153,284

[45] May 8, 1979

[54] PAWL LATCH

[75] Inventor: Andrew C. W. Wright, Farnham, England

[73] Assignee: Dzus Fastener Co. Inc., West Islip, N.Y.

[21] Appl. No.: 886,148

[22] Filed: Mar. 13, 1978

[51] Int. Cl.[2] ..... E05C 3/04

[52] U.S. Cl. ..... 292/202; 292/209

[58] Field of Search ..... 292/202, 203, 204, 205, 292/206, 207, 208, 209, 210, 211, 212, 349, 304

[56] References Cited

U.S. PATENT DOCUMENTS

| | | | |
|---|---|---|---|
| 2,409,822 | 10/1946 | Allen | 292/202 X |
| 2,592,239 | 4/1952 | Brown | 292/202 UX |
| 3,023,601 | 3/1962 | Luikart et al. | 292/207 X |
| 3,059,181 | 10/1962 | Benbow et al. | 292/205 X |
| 3,575,452 | 4/1971 | Blomgren | 292/202 |
| 3,715,531 | 2/1973 | Keeley | 292/202 X |
| 3,829,139 | 8/1974 | Storlie | 292/202 X |

FOREIGN PATENT DOCUMENTS

| | | | |
|---|---|---|---|
| 122445 | 4/1931 | Austria | 292/205 |
| 2335919 | 1/1975 | Fed. Rep. of Germany | 292/202 |
| 87587 | 4/1956 | Norway | 292/204 |

*Primary Examiner*—J. Franklin Foss

[57] ABSTRACT

The invention relates to a pawl latch which comprises a bush having a head, and a latching arm spaced axially from the head and extending in a direction transverse to the axis of the bush. The latch includes at least one resilient leg positioned on a side of the bush opposite the latching arm and extending back towards the head. The latch is adapted so that it may be inserted in an aperture in a panel at an angle, latching arm first, and then pushed completely into the aperture until the underside of the head engages the front face of the panel and the resilient leg, having been deflected on being pushed through the aperture, springs out to engage the rear face of the panel. The latch is maintained in position in the aperture on the one side between the leg and the underside of the head and on the other side between the latching arm and the underside of the head.

7 Claims, 7 Drawing Figures

PAWL LATCH

The present invention relates to latches and more particularly to pawl latches.

Pawl latches usually have an elongate shank on which is transversely mounted a latch arm. The latch is normally mounted on a panel, such as for example a door and is operated simply by rotating the stud through about 90° so that the latching arm is moved into or out of engagement with an abutment on a support member for the door or panel. Usually, the stud and latching arm are mounted on the panel by means of a housing.

Recently however it has been proposed to dispense with the housing and pawl latches have been produced which comprise solely a stud member and a latching arm. Such latches can have a very short axial dimension, can be inexpensive to manufacture and are relatively simple to install. However, whilst requiring less installation time than pawl latches having housings, which have to be mounted to the panel by, for example, rivets these newer pawl latches require first the stud part to be pushed through the aperture in the panel in which it is to be retained and then the latching arm to be mounted from the rear side of the panel.

There is therefore a need for a simple pawl latch which can be inserted in an aperture solely from the front without requiring subsidiary operations such as the later fixing of the latching arm.

According to the present invention such a latch comprises a bush having a head; a latching arm spaced axially from the head and extending in a direction transverse to the axis of the bush, and at least one resilient leg positioned on a side of the bush opposite the latching arm and extending back towards the head, the arrangement being such that the latch may be inserted in an aperture in a panel at an angle, latching arm first, and then pushed into the aperture until the underside of the head engages the front face of the panel and the resilient leg, having been deflected on being pushed through the aperture springs out to engage the rear face of the panel, the latch being maintained in position in the aperture on the one side between the leg and the underside of the head and on the other side between the latching arm and the underside of the head.

Preferably, the latching arm is formed by a transverse extension on the bush and a resilient metal clip housed in the extension. In such a case, the resilient leg or legs may be formed integrally with the bush or with the metal clip forming the latching arm.

Two examples of pawl latches according to the invention will now be described with reference to the accompanying drawings in which.

The two examples are very similar and therefore the same reference numerals will be used to indicate the same or similar parts in each example.

Figure 1:
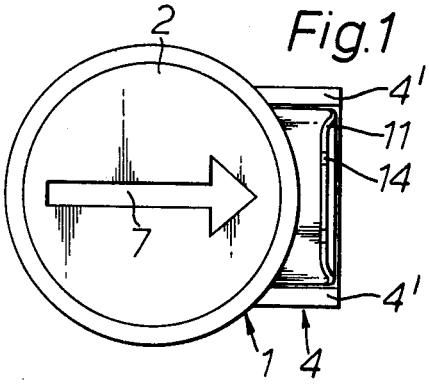
FIG. 1 illustrates a first latch in plan view.
Figure 2:
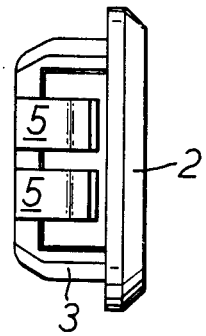
FIGS. 2 and 3 illustrate two opposite elevations of the latch.
Figure 3:
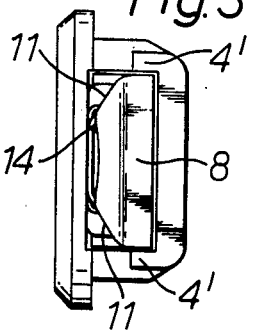
Figure 4:
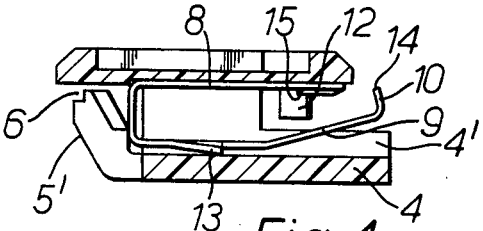
FIGS. 4 and 5 show the latch in section, before and after mounting in position on a panel.

In both examples the bush 1 is formed of a resilient plastics material such as nylon, and includes an enlarged head 2 which has a part-cylindrical hollow shank 3 extending therefrom. At the opposite end of the hollow shank 3 from the head 2 there is formed, integrally with the bush a transverse channel-shaped extension 4. On the opposite side of the bush a pair of legs 5, are positioned, again integrally formed with the bush. The legs are inclined, as shown in FIG. 4, upwardly and outwardly from the base of the bush towards the head 2 so as to define camming surfaces 5', but do not meet with the head 2. The legs 5 have recesses 6 into which the edge of an aperture 21 in a cover panel 20 (see FIG. 5) fits when the pawl latch is pushed into the circular aperture.

As the latch is inserted into an aperture, latching arm first, the leg or legs 5 are forced radially inwards at their free ends and then spring out again to complete installation of the latch in the panel 20.

In the head 2 there is formed an arrow-shaped recess 7, which points in the direction of the transverse channel 4 to indicate the orientation of the latching arm or pawl, which is partly formed by the channel 4, but also by a metal spring clip 8 which is inserted along the channel 4 between the two side walls 4'. The recess also enables the engagement of a tool such as a screw-driver for turning the latch.

The spring clip 8 includes an upwardly extending inclined portion 9 which joins, at its outer end, with a further inclined portion 10, inclined in the opposite direction, but at a lesser angle to the axis of the bush. This portion 10 in use engages the rear of a support 22 to hold the panel 20 to the support 22 and includes chamfered end surfaces 11 which, on rotation of the latch into the operating position, enable the latching arm or pawl to ride resiliently over the edge of, for example, the support 22 to which the panel 20 is to be fastened. Preferably the spring clip will be formed of spring steel.

To facilitate operation of the latch and to centralise the bush in the aperture, a pair of tangs 12 are formed extending downwardly from the upper part of the spring clip 8. The spring clip itself is retained in the channel 4 by means of a sprag 13 which engages the bottom of the channel in the fashion of a barb and prevents its withdrawal outwards.

Figure 5:
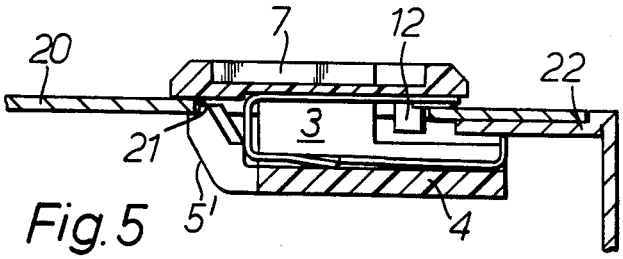

This latch is particularly useful for applications on metal trunking for say electrical wiring, such as shown in FIG. 5. The upper surface 14 on the inclined end part 10 and the underneath surface 15 of the upper edge part of the clip 8 are roughened so that they scrape off any thin layer of paint on the metal parts of the trunking to provide electrical continuity between the support 22 and the panel 20. In this way, the panel itself, whilst being completely removable from a support part of the trunking can, when in its latched position, be electrically connected to the remainder of the trunking to enable satisfactory earthing.

The composite form of the latching arm or pawl will ensure that the metal spring clip does not foul any wiring within the trunking and is therefore an additional safety factor.

Figure 6:
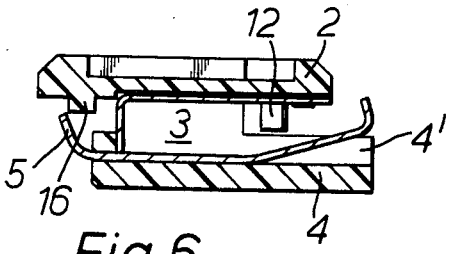
FIG. 6 is a cross-section through a second latch.
Figure 7:
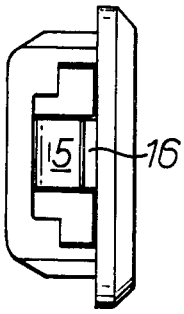
FIG. 7 is a side elevation of the second latch.

The latch shown in FIGS. 6 and 7 differs primarily only from that of the first example in that there is only one resilient leg 5 and this is formed integrally with the spring clip 8. The leg has no recess itself, but combines with an extending protrusion 16 and the underneath of the head 2 to define a recess in which the edge of the aperture fits. In other respects, the latch is identical to the first example.

I claim:

1. A pawl latch comprising a bush, said bush having a head, and a latching arm spaced axially from said head and extending in a direction transverse to the axis of said bush; said latch including at least one resilient leg, said leg being disposed on a side of said bush opposite said latching arm and extending back towards said head, said at least one resilient leg having a camming surface; said latch being adapted for insertion in an aperture in a panel at an angle, latching arm first, whereby said camming surface engages the side of said aperture, and whereby after said latch has been pushed into said aperture so that the underside of said head engages the face of said panel, the resilient leg, having been deflected on being pushed through said aperture, by engagement of said camming surface with said edge of said aperture, springs out resiliently to engage the rear face of said panel; said latch thereafter being maintained in position in said aperture on one side between said leg and said underside of said head and on the other side between said latching arm and said underside of said head.

2. A pawl latch according to claim 1, wherein said latching arm comprises a transverse extension of said bush together with a resilient metal clip, said clip being held in said transverse extension.

3. A pawl latch according to claim 2, wherein said extension is channel-shaped.

4. A pawl latch according to claim 1, wherein said resilient leg is formed integrally with said bush.

5. A pawl latch according to claim 1 wherein said resilient leg is formed integrally with said metal clip.

6. A pawl latch according to claim 1, wherein said bush is formed of a synthetic plastics material.

7. A pawl latch according to claim 1, further including a second resilient leg identical with said first resilient leg and disposed adjacent thereto.

* * * * *